US009533823B2

(12) United States Patent
Crane

(10) Patent No.: US 9,533,823 B2
(45) Date of Patent: Jan. 3, 2017

(54) METHOD AND APPARATUS FOR VENDING CLOTHES

(76) Inventor: Emma-Louise Pauline Crane, Wirral (GB)

( * ) Notice: Subject to any disclaimer, the term of this patent is extended or adjusted under 35 U.S.C. 154(b) by 106 days.

(21) Appl. No.: 14/361,824

(22) PCT Filed: Nov. 30, 2011

(86) PCT No.: PCT/GB2011/052365

§ 371 (c)(1),
(2), (4) Date: Aug. 25, 2014

(87) PCT Pub. No.: WO2013/079892

PCT Pub. Date: Jun. 6, 2013

(65) Prior Publication Data

US 2015/0034510 A1 Feb. 5, 2015

(51) Int. Cl.

| | |
|---|---|
| ***B65D 85/18*** | (2006.01) |
| ***B65B 25/20*** | (2006.01) |
| ***G07F 11/42*** | (2006.01) |
| ***G07F 11/38*** | (2006.01) |

(52) U.S. Cl.
CPC ..... *B65D 85/18* (2013.01); *B65B 25/20* (2013.01); *G07F 11/38* (2013.01); *G07F 11/42* (2013.01)

(58) Field of Classification Search
CPC ..... B65D 85/18; B65B 63/04
USPC ... 53/415, 438, 430, 442, 449; 206/278, 457
See application file for complete search history.

(56) References Cited

U.S. PATENT DOCUMENTS 6,021,626 A * 2/2000 Goodman ..... B65B 25/20 53/429
2004/0103033 A1* 5/2004 Reade ..... G06Q 20/20 705/16

FOREIGN PATENT DOCUMENTS

IT EP 2378495 A1 * 10/2011 ..... G07F 11/045

* cited by examiner

*Primary Examiner* — Nathaniel Chukwurah
(74) *Attorney, Agent, or Firm* — Fox Rothschild LLP

(57) ABSTRACT

A nightwear vending machine to be placed in and around the grounds of all hospitals, clinics and health care centers in the UK. The vending machine will sell women's, men's and children's pyjamas, night dresses, night gowns and slippers to all members of the public and be available 24 hours a day.

6 Claims, 1 Drawing Sheet

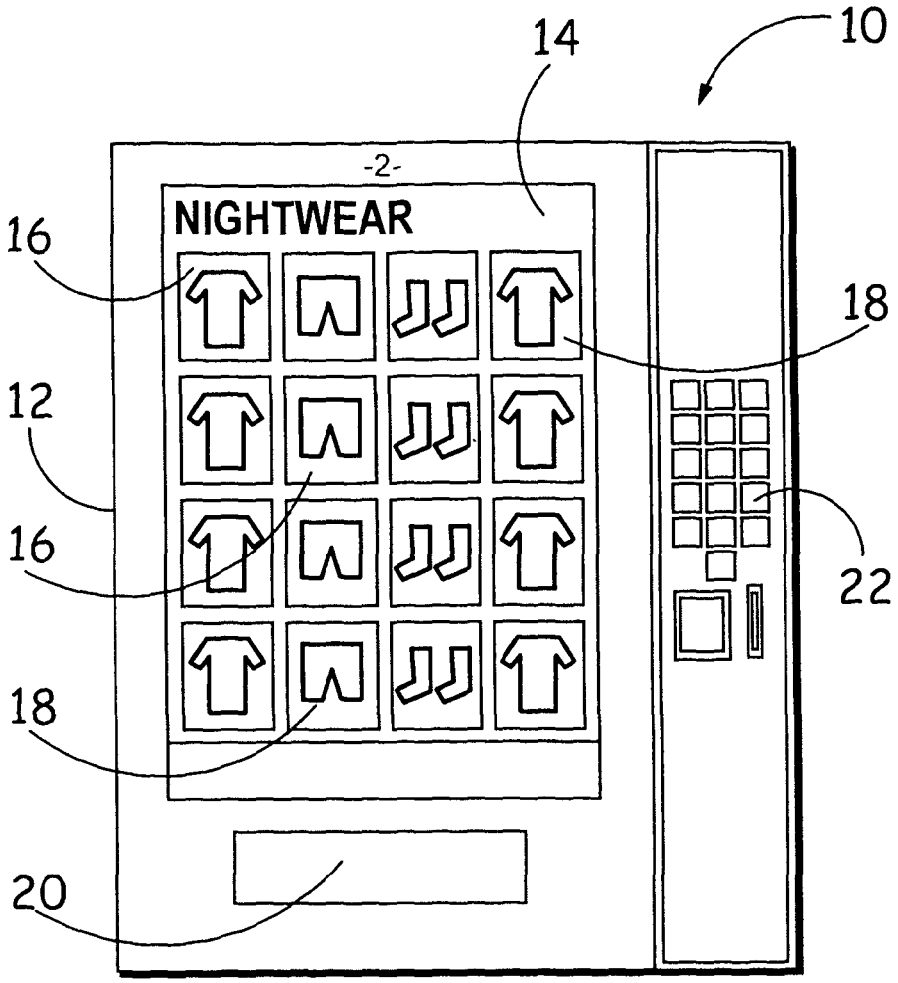
10
14
-2-
NIGHTWEAR
16
18
12
16
22
18
20

METHOD AND APPARATUS FOR VENDING CLOTHES

The present invention relates to methods and apparatus for storing, displaying, and vending nightwear apparel.

Clothing is typically displayed in stores on hangers or folded and placed on flat display surfaces. As consumers inspect the clothing items in the store, the clothing items are typically handled many times. As a result, the clothing items frequently become soiled or damaged and can no longer be sold.

In addition, in order for a sale to occur the store must be open and staffed. As we know, nightwear is already available to purchase in a number of retail shops. These shops however, have opening and closing times dictated by law and can often be a great distance away. Stores are unlikely to be staffed 24 hours a day, 7 days a week and particularly in hospitals this is very much less likely.

Adults and children can be unexpectedly admitted to hospital 24 hours a day, 7 days a week and in most cases are not permitted to leave the grounds to return home or do not have the option of purchasing spare clothing or nightwear as the local stores may be closed.

It is an object of the present invention to overcome or alleviate one or more of the problems associated with the prior art.

In accordance with a first aspect of the present invention there is provided a method for packaging and vending nightwear apparel, comprising:

forming said nightwear apparel into a compact shape;

packaging said apparel in said compact shape; and inserting said packaged nightwear apparel into a vending apparatus.

To overcome one or more of the problems associated with the prior art, the present invention provides a method and a vending machine that offers nightwear for sale and is available 24 hours a day proposes a solution.

This invention relates to the idea of providing a range of nightwear in a vending machine, to be placed in and around the grounds of all hospitals, clinics and health care centres in the UK. However prior to the present invention, there has been no available product that offers a nightwear vending machine for use 24 hours a day in or around hospital grounds, clinics or health care centres in the UK. Vending machines are also available in a large number of places but are mostly used to purchase food and drinks.

Pre-packaged clothing such as nightwear in a vending machine will ensure that all members of the public have access to purchase night garments at any time, without the need to loan a hospital gown (if available) or sleep in their original clothing.

Further advantages include the fact that children or loved ones do not need to be left unaccompanied whilst their family or friends try to solve the problem of obtaining night clothing for them to sleep in.

Hospitals may also benefit if a nightwear vending machine was available as it could reduce the amount of gowns they need to loan to their patients and also reduce their cleaning costs if patients chose to purchase their own nightwear.

The method for packaging and vending nightwear apparel may further comprise the step of shrink-wrapping said nightwear apparel in a shrink-wrap material.

The method for packaging and vending nightwear apparel may further comprise the step of applying labelling the packaged nightwear apparel.

The method of packaging may comprise the pre-step of sterilising the package and/or nightwear.

The method of packaging may comprise a pre-step of contacting the nightwear with an antibacterial composition. The anti-bacterial composition may be an anti-MRSA composition (methicillin resistant *staphylococcus aureus*).

Contacting the nightwear with an anti-bacterial composition may comprise spraying.

The vending apparatus may be configured to display the apparel in rows according to gender, age and size designations.

The vending apparatus may be located proximate to or in a hospital.

Preferably, the nightwear apparel comprises any one or more of the following: socks, underwear, dressing gown, toiletries, sanitary towels, nightie, pyjamas, one or more diapers, one or more nappies, baby clothing, such as, baby grow, vests and scratch mitts.

The apparel may comprise a toiletry bag comprising a plurality of toiletries.

Preferably, the vending machine may include underwear, so the patients can purchase fresh underwear without the embarrassment of asking for disposable underwear from the hospital (if available).

The nightwear apparel may be pre-packaged and labelled with individual sizes and descriptions on each garment, for sale in a vending machine.

The nightwear apparel may be in a compressed, rolled or folded state when packaged. The purpose is to reduce the volume of the clothing article for ease of transport, storage and vending.

Preferably, the nightwear article is rolled to prevent creasing.

The nightwear apparel may comprise toiletries.

Typically, for compressed apparel, the article can be inserted into a mould or dye having a cavity which is closed at one end. A plunger, dimensioned to form a close sliding fit in the cavity, is then inserted into the cavity, and a desired pressure applied to it for a certain period of time.

The nightwear apparel may be compressed sufficiently to form a generally stable, solidified body, which may be returned to its original shape by a vendor through manipulation of the article. Generally the shape of the cavity in the dye and the shape of the plunger, as well as the distance into the cavity the plunger must travel, are determined empirically based on the size and shape of the compressed clothing article.

The compressed, rolled or folded nightwear apparel may be packaged in any suitable means. The nightwear apparel may be packaged in a container.

The container may be made of composite cardboard, plastics and/or metal. Preferably the cylindrical container is comprises composite cardboard. The composite cardboard is more biodegradable than other materials used for packaging and thus more environmentally friendly.

The container may be releasably sealed using any suitable means to ensure that the content of the container is protected from the surrounding environment, to prevent soiling and/or contamination.

Preferably, the container is substantially cylindrical in shape.

The means for releasably sealing the container may comprise a foil seal and/or lid. The lid may be manufactured from any suitable means, such as for example, plastics.

Alternatively, the cylindrical container may comprise a can of steel, aluminium, or other metals, conventionally employed for storage of food or beverages. Preferably, a standard sized beverage can, may be used to package the clothing article. A conventional pull ring and scored line on the lid may be provided to permit the can to be opened by the consumer.

The clothing article may be shrink wrapped in clear plastic using conventional methods to ease insertion into and removal from the cap. The clothing article is then placed in the can, and the opposite circular end is attached to the cylindrical side in a conventional manner, thereby hermetically sealing the can.

The vending apparatus may be, by way of example, a conventional vending machine used for the vending of canned beverages. Typically, cans are stored in numerous stacks. If more than one flavour, brand or type of beverage is stocked in the machine, the types of beverage are arranged by type. Such a machine is stocked by a human user who unlocks a lock to permit a door to be opened to provide access to the interior of the vending machine. To obtain goods from the machine, a vendor operates a payment mechanism that detects when sufficient funds have been deposited to make a purchase.

The user then presses one of several buttons to select an item for purchase. The purchased item is permitted to fall to a delivery shelf by conventional techniques. The items are sealed cans containing compressed or folded clothing articles.

The vending apparatus may accept cash and/or may have an automated credit/debit card reader and verification device. The credit card reader could read various credit cards, smart cards, debit cards, and/or other purchase cards. In accordance with conventional credit card reader and verification device technology, credit card reader contains a card reader, a modem coupled to a telephone line, and suitable processors and memory to obtain card identification information magnetically encoded on a credit card, open a telephone connection to a credit card verification facility, transmit via such telephone connection information identifying the vending machine, the credit card, and the amount of the proposed purchase, to the credit card verification facility, receive an indication of purchase approval or disapproval, cause the vending machine to dispense product upon receipt of purchase approval, cause the vending machine to dispense product upon receipt of purchase approval, print a customer receipt, and transmit confirmation of the transaction to a processing facility. The vending apparatus may also be configured to transmit information, such as purchase information and inventory information, to a remote computer of the owner and/or operator of the vending machine. The vending apparatus may be provided with a numeric keypad to permit entry of numeric information, such as personal identification numbers for use of debit cards. The credit card reader and verification device may also contain a display for providing user instructions, information regarding card approval or disapproval, and other information.

When clothing is compressed before shipping, it is conventionally shrink-wrapped in clear plastic. Clothing items that have been compressed and shrink wrapped occupy a smaller volume than clothing items that are being shipped conventionally, and are not subject to direct handling by consumers, and are therefore advantageous when compared with conventional shipping and display of clothing items. However, the appearance of a compressed clothing article that has been shrink-wrapped in clear plastic is not particularly attractive to the consumer.

The use of cans of conventional sizes permits the use of existing vending and dispensing machines. The use of vending machines also permits the sale of clothing at locations that have too low a volume, are too small, or otherwise are unsuitable for the use of clerks to accomplish sales. The vending machines may be located at hospitals, cinemas, restaurants, hotels, stadiums, airports, train stations, shopping malls, and other locations. As there is no handling of the cans after the vending machines are loaded, there is less opportunity for shrinkage than there is when clerks and consumers handle the merchandise at retail.

There are advantages to shipping clothing articles compressed in cans or other suitable packaging. Shipping compressed clothing articles in cans results in significant volume savings. Also there is no need for clothes hangers.

In accordance with a second aspect of the present invention, there is provided a nightwear apparel vending apparatus, comprising a housing closed by a front wall, a plurality of trays arranged in rows within the housing upon which are supported nightwear apparel as described hereinabove; a drop shaft between the trays and the front wall; a collection bin communicating with the drop shaft and having a window through which the collection bin communicates with the outside, the window having a releasable hatch movable between a closed position and an open position; wherein a selected nightwear apparel can be moved from a tray to the collection bin and the hatch released enabling the selected nightwear apparel to be withdrawn directly from the bin through the window.

The apparatus may further comprise payment mechanism for receiving payment for nightwear apparel and means for controlling the release of the corresponding nightwear apparel from the appropriate tray into the collection bin and the subsequent release of the hatch for the collection of the nightwear apparel.

An embodiment of the present invention will now be described, by way of example only, with reference to the accompanying FIGURE, in which:

FIG. 1 shows a vending apparatus in accordance with the present invention.

FIG. 1 shows apparatus 10 having a housing 12 closed by a front wall 14. A plurality of trays 16 are arranged in rows within the housing upon which are supported nightwear apparel 18.

There is a drop shaft between the trays 16 and the front wall 14 and a collection bin communicating with the drop shaft and having a window 20 through which the collection bin communicates with the outside.

The window 20 has a releasable hatch movable between a closed position and an open position wherein a selected nightwear apparel can be moved from a tray to the collection bin and the hatch released enabling the selected nightwear apparel to be withdrawn directly from the bin through the window.

There is a control panel 22 mounted in the front wall 14. The control panel has a series of buttons labelled with whole digits from 0 to 9, a number of slots for inserting coins, cash or credit/debit cards and a recess for receiving change.

There is a controller for controlling the release of the corresponding nightwear apparel from the appropriate tray into the collection bin and the subsequent release of the hatch for the collection of the nightwear apparel once the payment has been made.

It will be apparent to those skilled in the art that various modifications and variations can be made without departing from the spirit or scope of the invention. Thus, it is intended that the present invention cover the modifications and variations of this invention provided that they come within the scope of the appended claims and their equivalents.

The invention claimed is:

1. A method for packaging and vending nightwear apparel, comprising:

forming said nightwear apparel into a compact shape;

packaging said apparel in said compact shape; and inserting said packaged nightwear apparel into a vending apparatus wherein the method further comprises a pre-step of sterilising the nightwear apparel and said vending apparatus is located proximate to or in a hospital, clinic or healthcare centre.

2. The method for packaging and vending nightwear apparel as recited in claim 1, further comprising the step of shrink-wrapping said nightwear apparel in a shrink-wrap material.

3. The method for packaging and vending nightwear apparel as recited in claim 2, further comprising the step of applying labelling the packaged nightwear apparel.

4. The method for packaging and vending nightwear apparel as recited in claim 1, wherein the vending apparatus is configured to display the apparel in rows according to gender, age and size designations.

5. The method of claim 1 wherein the nightwear apparel comprises any one or more of the following: socks, underwear, dressing gown, nightie, one or more diapers, one or more nappies, toiletries, one or more sanitary towels, pyjamas, baby grow, vest and scratch mitts.

6. The method for packaging and vending nightwear apparel as claimed in claim 1, further comprising a pre-step of contacting the nightwear apparel with an antibacterial composition.

* * * * *